United States Patent [19]

Wilkman et al.

[11] Patent Number: 4,602,895

[45] Date of Patent: Jul. 29, 1986

[54] DRILLING PLATFORM

[75] Inventors: Göran Wilkman, Espoo; Torsten Heideman, Kauniainen, both of Finland

[73] Assignee: Oy Wärtsilä Ab, Helsinki, Finland

[21] Appl. No.: 504,294

[22] Filed: Jun. 14, 1983

[30] Foreign Application Priority Data

Jun. 15, 1982 [FI] Finland ..... 822158

[51] Int. Cl.[4] ..... E02B 15/02; E02B 17/00; B63B 35/08

[52] U.S. Cl. ..... 405/211; 405/217

[58] Field of Search ..... 405/61, 211, 217; 114/40, 41, 42

[56] References Cited

U.S. PATENT DOCUMENTS 3,759,046 9/1973 Anders ..... 405/211
3,807,179 4/1974 Stone ..... 405/61
4,077,225 3/1978 Lichtenberger et al. ..... 405/211
4,102,144 7/1978 Anders ..... 405/211

FOREIGN PATENT DOCUMENTS 2537918 3/1977 Fed. Rep. of Germany ..... 405/217

*Primary Examiner*—David H. Corbin
*Attorney, Agent, or Firm*—Dellett, Smith-Hill and Bedell

[57] ABSTRACT

An off-shore drilling platform or the like supported by support legs standing on the bottom of the sea is converted to withstand ice pressure occurring in ice filled waters by providing those portions of said drilling platform, which are to be protected against ice pressure, with protective structures below the platform. The drilling platform and/or the protective structures are then, when ice occurs, lowered along the support legs to a level where the protective structures partly extend below the surface of the ambient water.

14 Claims, 4 Drawing Figures

Figure 1:
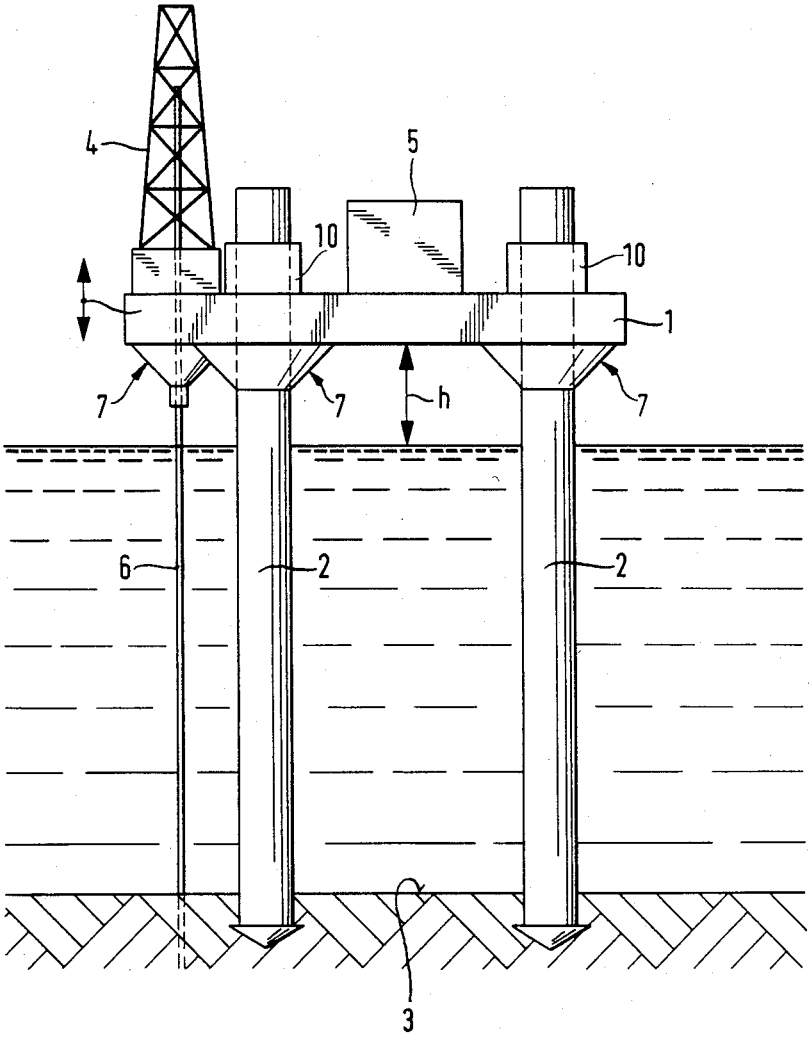

Fig. 3
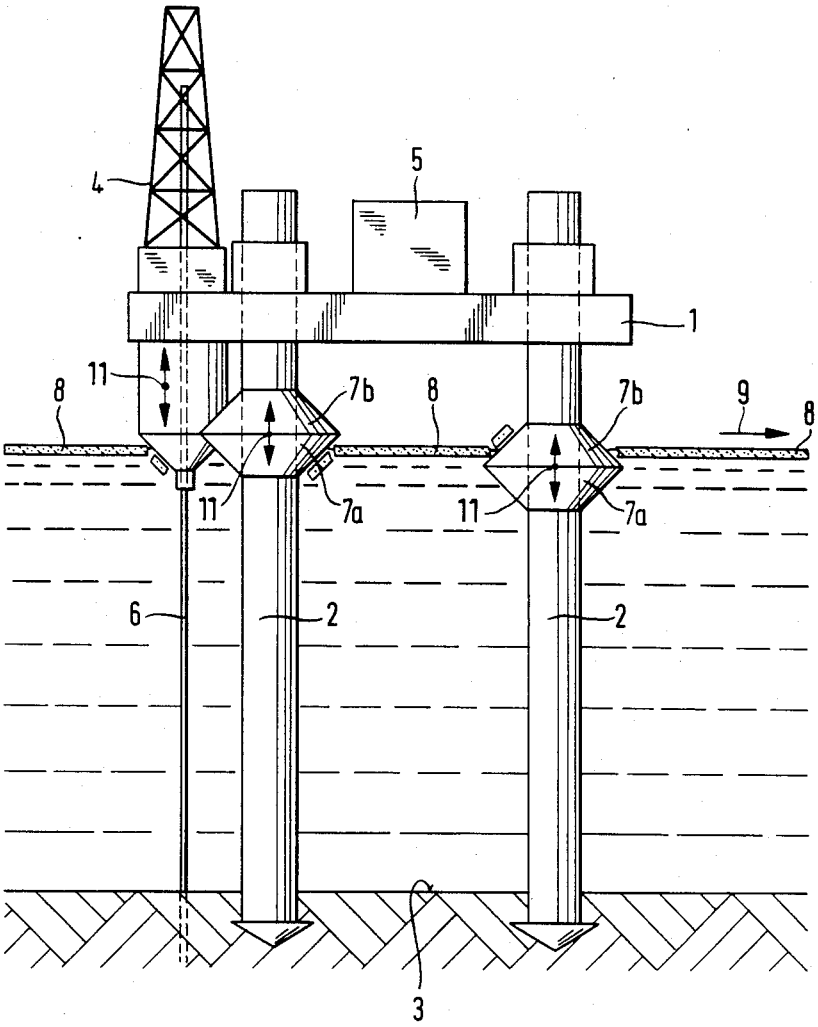
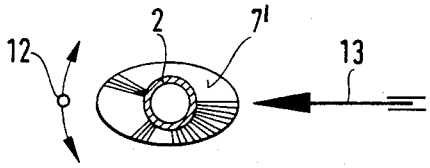
Fig. 4

DRILLING PLATFORM

The invention relates to a method for use in ice conditions of a drilling platform or the like supported by means of support legs on the bottom of the sea.

Drilling platforms with a sea bottom support, so called jack-up platforms, are usually constructed only for openwater conditions. Oil prospecting is, however, nowadays carried out also in areas which are at least during a part of the year, fully or partly covered by ice. Special drilling platforms for ice conditions have been constructed and these are usually heavy floating or bottom support structures with no height adjustment possibilities. Conventional jackup platforms cannot be used in areas, where ice problems may occur, and hence, it has been necessary to use expensive, fully ice-protected structures in such areas, where the ice conditions are rather mild and/or there is ice only occasionally.

It has been suggested to use heat transfer and/or ice cutter means for ice protection as shown in U.S. Pat. No. 3,759,046 and Swedish Patent Specification No. 391 549. A vertically movable and rotatable ice shield is shown in U.S. Pat. No. 4,102,144. None of these constructions would be particularly useful in realistic ice conditions, because they fail to recognize the true nature of moving natural ice and the ice pressure caused thereby.

The object of the invention is to present a method for modifying the conventional support leg carried drilling platform, so that it can be used also in ice conditions. According to the present invention there is provided a method for using an off-shore drilling platform or the like in ice-filled waters, which platform is supported by support legs standing on the bottom of the sea, said method including the steps of providing those portions of said drilling platform, which are to be protected against ice pressure, with protective structures below said platform and, when ice conditions occur, lowering said platform and/or said protective structures along said support legs to a level where said protective structures partly extend below the surface of the ambient water. By these means the object of the invention will be obtained. In a platform of this type, the most important thing is to protect the drill shaft and the support legs of the platform against the horizontal load caused by a moving ice field.

In a preferred embodiment of the invention, the protective structures are made vertically adjustable. Thus, it will not be necessary to adjust the vertical position of the platform itself, which is a slow and complicated operation.

By forming the protective structures so that, in dependence on their vertical position, they bend the ice either upwards or downwards, it is possible, by choosing the bending direction of the ice, to regulate the vertical forces acting on the platform so that they counterbalance the overturning forces acting on the platform due to the movement of ambient ice.

The ice bending portion of the protective structures can be cone-shaped, converging in the ice bending direction and having a vertical extension of at least twice the thickness of the thickest level ice to be broken.

The inclination of the ice bending surface relative to a horizontal plane is chosen within the range 25° . . . 65°, preferably within the range 35° . . . 55°.

A tube like portion can be attached to the narrower end of the cone-shaped portion of the protective structure. The axial extension of this tube portion is preferably at least one quarter of the axial extension of the cone-shaped portion.

If the protective structures of the drill shaft and the support legs are so constructed, that they have a different cross-section area in different directions, the protective structures are made turnable about a vertical axis, so that the most favourable cross-section can always be turned against the ice pressure.

Since the support legs of a jack-up platform usually have such a construction that they poorly withstand ice pressure, it is important that the support legs also are provided with protective structures reducing the horizontal ice pressure acting on the support legs. For vertical adjustment of these protective structures it is advantageous to use the same rack or other force transmission arrangement by means of which the platform itself is adjusted vertically. The protective structures of the support legs or some of the support legs and of the drill shaft can also be integrated into one unit vertically movable independently of the platform.

The vertical position of the protective structures of the support legs can be so chosen, that the overturning moment generated by the ice load is balanced by so selecting the ice bending either upwards or downwards at different support legs, that thereby proper balancing vertical reaction forces are generated.

Figure 2:
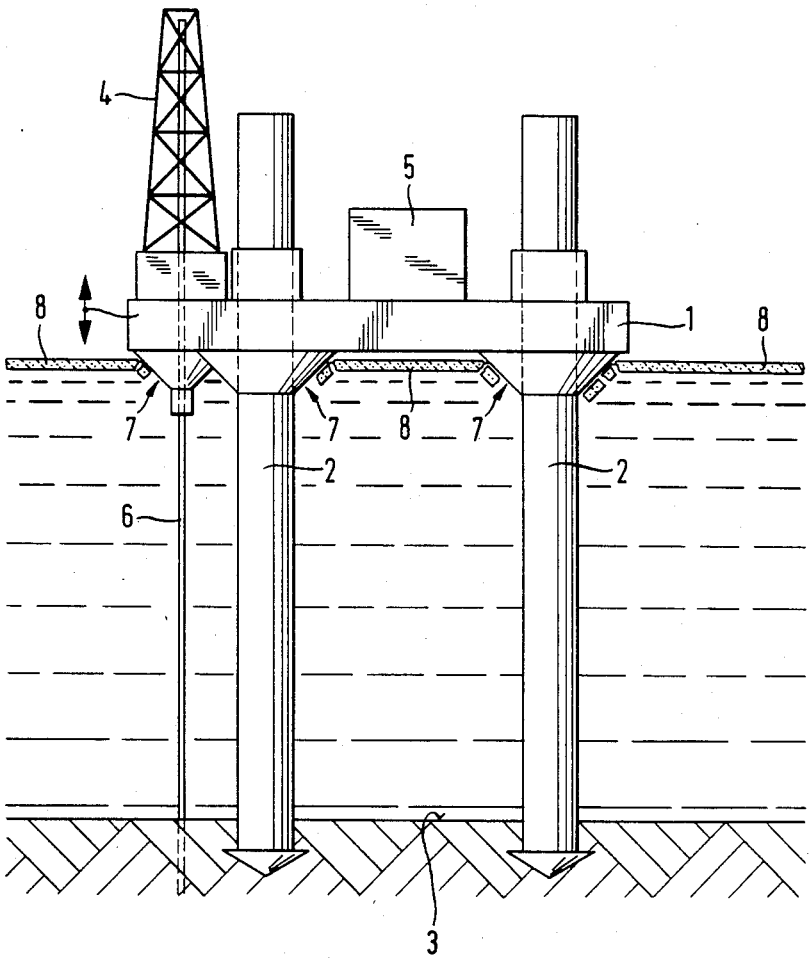

The invention will now be described, by way of example, with reference to the accompanying drawing, wherein FIG. 1 shows a drilling platform according to the invention in open water conditions, FIG. 2 shows the same drilling platform in ice conditions, FIG. 3 shows an alternative way of using the platform according to FIG. 1 in ice conditions, FIG. 4 is a horizontal sectional view through a support leg illustrating in plan view a protective structure having different cross-sections in different directions.

In the drawing, numeral 1 indicates the actual drilling platform and 2 its support legs by means of which the platform 1 is supported on the bottom 3 of the sea. The platform is a jack-up platform, and can be raised or lowered on the support legs by means of jacking mechanisms 10. The platform 1 has a drilling tower 4, dwelling and service facilities 5 as well as other necessary buildings and equipment not shown in the drawing. In the drilling tower 4, there is a drill shaft 6 having a drill at its lower end for drilling a hole into the ground forming the bottom of the sea.

When the drilling platform works in open sea, the distance h between the bottom of the platform 1 and the water surface is so great that not even very high waves can hit the platform 1. This is a common principle in jack-up platforms.

One way of using the invention is shown in FIG. 2. In ice conditions the platform 1 is lowered on its support legs 2 so, that protective structures 7 attached to the platform 1 and arranged around the drill shaft 6 and preferably also around the support legs 2 are positioned at the level of the water surface, so that moving ice 8 floating at the water surface hits the tapered portions of the protective structures 7 and is broken by means of bending against the tapered surfaces of the protective structures. It is necessary to make sure that the protective structures 7 have a sufficient extension below the water surface. It is usually sufficient that the protective structures go down to a level at least 5 m below the water surface.

FIG. 3 shows a more sophisticated method of using a platform according to FIG. 1 in ice conditions. According to this alternative, only the protective structures 7 are moved vertically, as shown by arrows 11. They may be provided with a portion *7a* tapered downwardly for bending the ice downwards as well as a portion *7b* tapered upwardly for bending the ice upwards. The vertical reaction force caused by the bending of the ice can then be used for improving the stability of the entire platform construction as shown in FIG. 3.

By applying the invention as shown, a normal jack-up platform can be used even in rather severe ice conditions. In a very severe emergency case, when there is a risk of the whole platform being destroyed due to strong ice pressure, the platform 1 can be lowered so that it by its weight crushes the ice mass gathering around the support legs, whereafter the platform is again lifted up out of direct contact with the ice.

FIG. 4 illustrates a protective structure 7' that has different cross-section areas in different directions and is turnable about the vertical axis of the leg 2 as indicated by the arrow 12 so that the most favorable cross-section can always be turned towards the ice pressure, indicated by the arrow 13.

The invention is not limited to the described examples, but several modifications thereof are feasible within the scope of the attached claims.

We claim:

1. A method for using an off-shore drilling platform or the like in ice-filled waters, which platform is supported by support legs standing on the bottom of the sea, said method including the steps of providing those portions of said drilling platform which are to be protected against ice pressure with protective structures below said platform and, when ice conditions occur, lowering said platform and/or said protective structures along said support legs to a level where said protective structures partly extend below the surface of the ambient water and maintaining the protective structures each in a rigid and fixed relationship with respect to the support legs.

2. A method according to claim 1, in which said protective structures are made vertically adjustable, independently of the vertical position of said platform.

3. A method according to claim 1, in which said protective structures are provided with an ice bending portion formed to break the ambient ice by means of bending and are so adjusted in a vertical direction, that they bend said ice selectively downwards in order to break the ice or upwards in order to stabilize the platform against the overturning moment applied to the platform by pressure from horizontally moving ice.

4. A method according to claim 3, in which said ice bending portion of the protective structures is given a form tapering in the ice bending direction and is given a vertical extension of at least two times the greatest thickness of the thickest level ice to be encountered in the area where said platform is situated.

5. A method according to claim 3, wherein said ice bending portions of the protective structures are formed by surfaces inclined to the horizontal at an angle of substantially 25° to 65°.

6. A method according to claim 5, wherein said angle is substantially 35° to 55°.

7. A method according to claim 4, wherein at least one of the protective structures, at the narrower end of its tapering portion, is provided with a tube-like portion.

8. A method according to claim 7, wherein said tube-like portion has an axial length of at least one fourth of the axial length of said tapering portion.

9. A method according to claim 1, wherein at least one of said protective structures is constructed to present a different cross-section in different directions and is turnable in a horizontal plane, and the method comprises the step of turning the protective structure so as to direct that portion of the structure that is most advantageous for ice breaking against the direction of motion of the ambient ice.

10. A method according to claim 1, wherein the support legs are provided with protective structures, and the method comprises moving the protective structures along the support legs using the same force transmitting means as are employed when the drilling platform is moved vertically along the support legs.

11. A method according to claim 1, wherein the support legs are provided with protective structures, which protective structures each include an ice bending portion formed to break the ambient ice by bending upwards or downwards, depending on the vertical position of the protective structures, and the method comprises positioning the protective structures along the support legs so that the overturning moment applied to the platform by pressure from horizontally moving ice is balanced by the reaction forces exerted on the protective structures on the different support legs by ice being bent upwards and downwards.

12. A method according to claim 1, comprising lowering the platform onto the ice in severe ice conditions so that the weight of the platform breaks the ice about the support legs, and thereafter raising the platform.

13. An off-shore drilling platform or the like having support legs for supporting the platform above the water by standing on the sea bottom, said platform being provided with protective structures for protecting the support legs against the force of moving ice when the structure is situated in ice-filled water, said protective structures being formed to break ice by bending, and said platform being provided with means for keeping the protective structures well above the surface of the water when the platform is situated in open water and for lowering them to the water surface level when ice occurs and maintaining them in a rigid and fixed relationship with respect to the support legs.

14. An off-shore drilling platform having a drill shaft for drilling the sea bottom, the platform being provided with a protective structure for protecting the drill shaft against the force of moving ice when the platform is situated in ice-filled water, said protective structure being formed to break ice by bending, and said platform being provided with means for keeping the protective structure well above the surface of the water when the platform is situated in open water and for lowering it to the water surface level when ice occurs and maintaining it in a rigid and fixed relationship with respect to the longitudinal direction of the drill shaft.

* * * * *